United States Patent [19]

Bobb

[11] 4,122,302

[45] Oct. 24, 1978

[54] TWO WAY DYNAMIC AND ELECTROSTATIC SPEAKER ENCLOSURE WITH SIDE VENT FOR GREATER HIGH FREQUENCY DISPERSION

[75] Inventor: Lloyd J. Bobb, Glenside, Pa.

[73] Assignee: Chester C. Pond, Doylestown, Pa. ; a part interest

[21] Appl. No.: 813,666

[22] Filed: Jul. 7, 1977

Related U.S. Application Data

[60] Continuation of Ser. No. 705,129, Jul. 14, 1976, abandoned, which is a continuation of Ser. No. 476,893, Jun. 6, 1974, abandoned, which is a division of Ser. No. 79,488, Oct. 9, 1970, Pat. No. 3,821,490.

[51] Int. Cl.[2] ..... H04R 1/20

[52] U.S. Cl. ..... 179/1 E; 181/145; 181/155

[58] Field of Search ..... 179/1 E, 1 GA, 111 R, 179/115.5 PS; 181/144, 145, 146, 147, 148, 154, 155, 156, 198, 199, 152

[56] References Cited

U.S. PATENT DOCUMENTS

| | | | |
|---|---|---|---|
| 2,491,982 | 12/1949 | Kincart | 181/156 |
| 2,993,097 | 7/1961 | Swift | 179/1 E |
| 3,135,838 | 6/1964 | Wright | 179/111 R |
| 3,389,226 | 6/1968 | Peabody | 179/111 R |
| 3,578,103 | 3/1971 | Lennes | 181/156 |
| 3,588,355 | 6/1971 | Holm | 179/1 E |

FOREIGN PATENT DOCUMENTS

| | | | |
|---|---|---|---|
| 1,160,894 | 1/1964 | Fed. Rep. of Germany | 179/1 GA |
| 1,291,790 | 4/1969 | Fed. Rep. of Germany | 179/1 E |
| 506,042 | 5/1939 | United Kingdom | 181/31 B |
| 847,144 | 9/1960 | United Kingdom | 181/156 |

*Primary Examiner*—George G. Stellar
*Attorney, Agent, or Firm*—Kenneth P. Synnestvedt

[57] ABSTRACT

An electroacoustic transducer, especially an electrostatic speaker embodying a conductive perforated backing plate, a dielectric membrane carrying a conductive coating, and an intervening spacing layer formed of acoustically porous or transparent dielectric material having substantially uniformly and widely distributed local areas of contact with the membrane. A speaker frame is provided in which the perforated plate is mounted and the speaker preferably comprises a pair of membranes, spaced at opposite faces of the perforated plate, the membranes being adhesively secured to the frame. The membrane coating is also interrupted to provide electrically separated areas proportioned respectively to efficiently generate sound waves of different frequencies. A special form of speaker system is also provided incorporating both an electrostatic speaker and a dynamic speaker.

3 Claims, 12 Drawing Figures

TWO WAY DYNAMIC AND ELECTROSTATIC SPEAKER ENCLOSURE WITH SIDE VENT FOR GREATER HIGH FREQUENCY DISPERSION

This is a continuation of application Ser. No. 705,129 filed July 14, 1976 now abandoned, which is a continuation of Ser. No. 476,893 filed June 6, 1974 now abandoned, which is a division of Ser. No. 79,488 filed Oct. 9, 1970 and issued June 28, 1974 as U.S. Pat. No. 3,821,490.

This invention relates to electroacoustic tranducers such as microphones and speakers, and the invention is particularly concerned with an electrostatic speaker and speaker system.

Though widely recognized to be highly effective in the reproduction of high frequency sound waves, electrostatic speakers have for the most part not been widely adopted or accepted for one or more of a number of reasons. In the first place it has been difficult to provide an electrostatic speaker having a reasonably effective power output level without either resorting to an excessive power input or to the use of speaker elements of such large size that it has not been possible to accommodate them within the confines of practical speaker cabinets.

Another problem encountered with many prior electrostatic speakers is that they have required the mounting of the membrane element of the speaker under tension, in order to maintain appropriate spacing between that element and the conductive backing element, between which elements both the bias voltage as well as the signal voltage are impressed. This requirement for tensioning of the membrane presents a manufacturing problem tending to increase the cost of the electrostatic speaker.

The present invention represents a new approach to the foregoing as well as other problems heretofore encountered in connection with electrostatic speakers. Briefly, an electrostatic speaker according to the present invention includes a perforated electrically conductive element or electrode which is relatively inflexible, a highly flexible dielectric membrane carrying an electrically conductive coating, and a novel form of spacing means between the plate and membrane comprising acoustically transparent or porous and compressible dielectric material in engagement with both the plate and the membrane and having points or areas of contact substantially uniformly and widely distributed over the surface area of the membrane. With the uniform and wide distribution of the points or areas of contact, the desired uniform stiffness of the membrane and the accurate spacing between the membrane and the perforated plate is established and maintained without the necessity of resorting to tensioning of the membrane. This construction further has numerous other advantages including extensive increase in output of the electrostatic speaker in relation to the input and size of the speaker elements, reasons for this being fully explained hereinafter.

Other objectives of the invention which will be explained more fully hereinafter are to provide an electrostatic speaker having more power handling ability per unit area of the speaker. The arrangement of the invention also contemplates an electrostatic speaker having a wider overall operating frequency range. Moreover, the speaker of the invention provides more uniform response over the operating frequency range.

The invention also makes possible design and construction of electrostatic speakers adapted to meet the requirements of a broad range of operating conditions and desired operating capabilities, both with respect to frequency range of response and uniformity of response, as well as with respect to a number of other operating characteristics of the speaker.

Another objective of the invention is to tend to broaden and to equalize the angular range of distribution of all frequencies reproduced by the speaker, as compared with the angular range of prior speakers. This objective is achieved in part by construction of the electrostatic speaker itself and in part by a novel arrangement of a speaker system incorporating an electrostatic speaker, as will further appear.

In accordance with still another aspect of the invention, provision is made for the mounting of the electrostatic speaker of the present invention in an extremely simplified frame structure adapted to high speed and economic production, and the invention also provides a simplified arrangement for making electrical contact with the conductive coatings on the membranes of the speaker and also with the perforated backing plate.

How the foregoing objects and advantages are attained will appear more fully from the following description referring to the accompanying drawings, which illustrate a typical embodiment of a speaker and speaker system according to the present invention and, in which.

Figure 5:
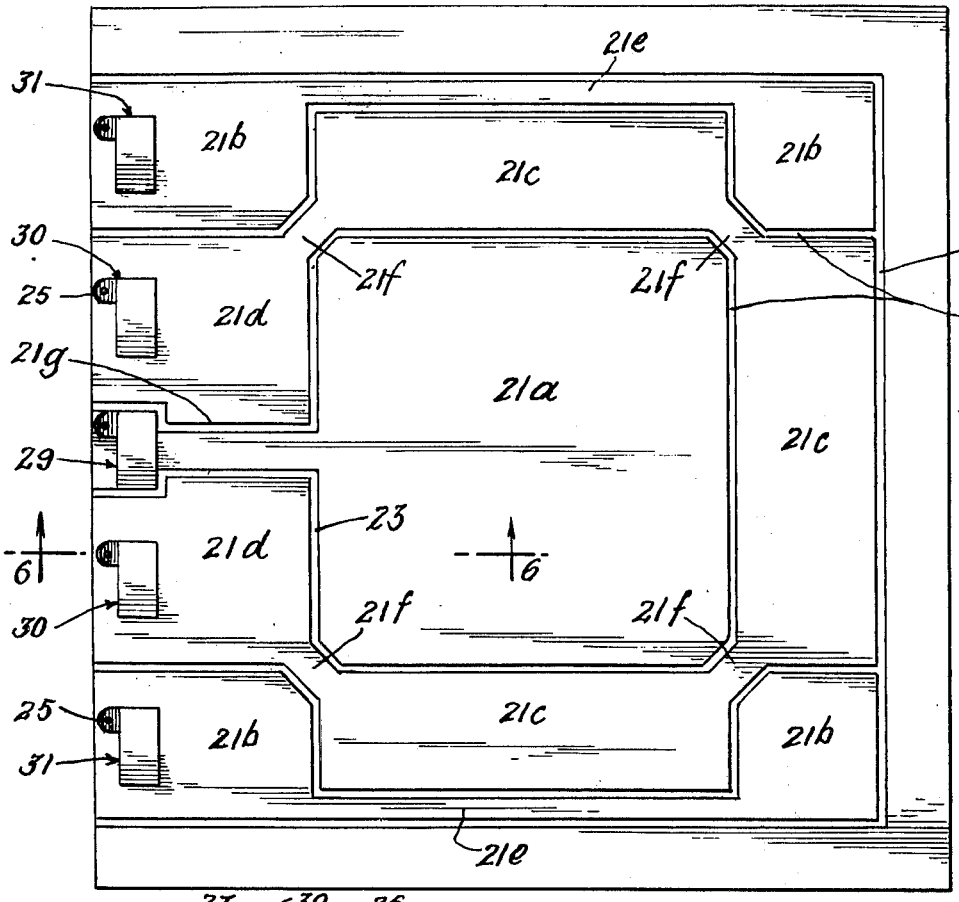
FIG. 5 is a view similar to FIG. 1 but illustrating the full face pattern of the membrane and the division thereof into electrically separated areas, for purposes to be explained.
Figure 6:
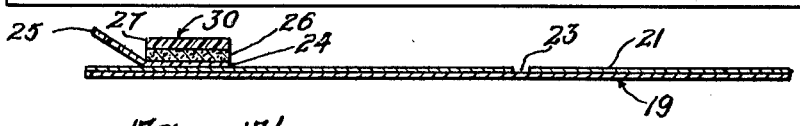
Figure 7:
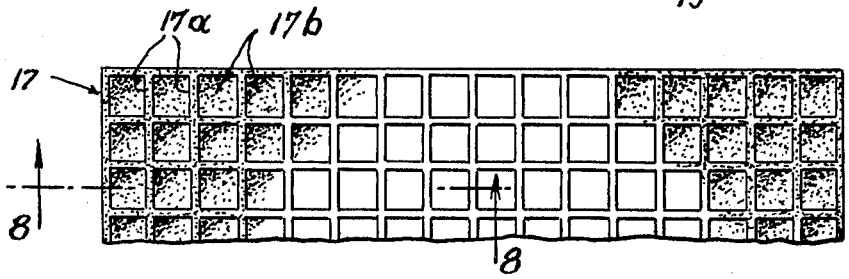
Figure 8:
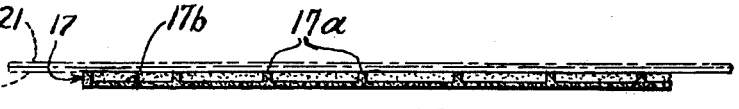
Figure 5A:
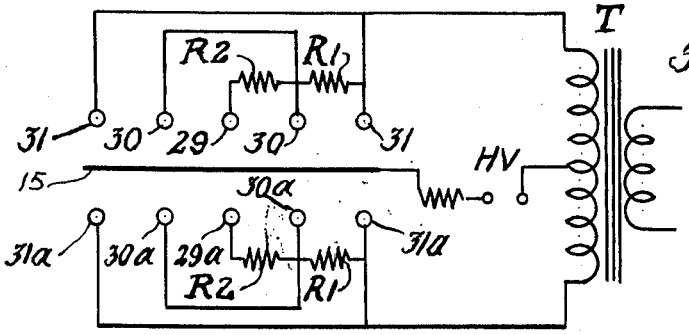
Figure 9:
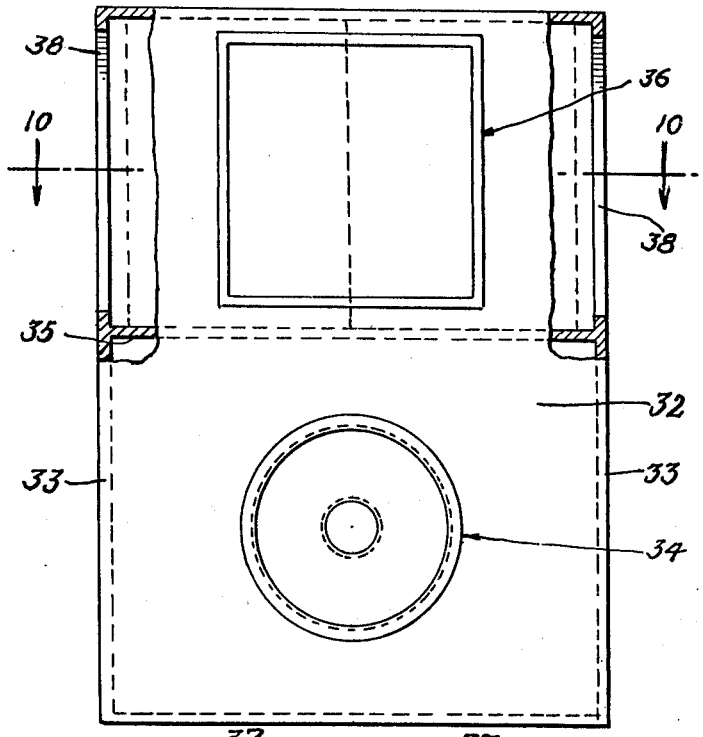
Figure 10:
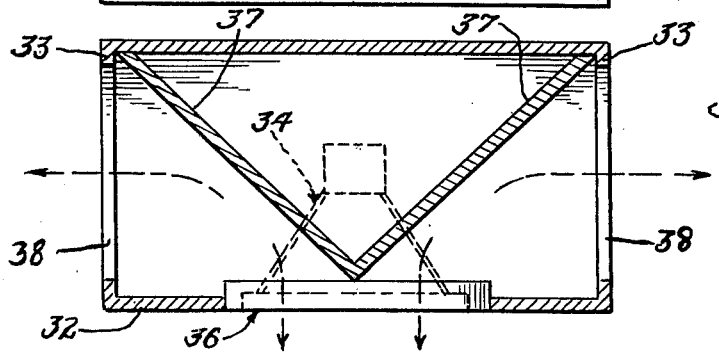
Figure 11:
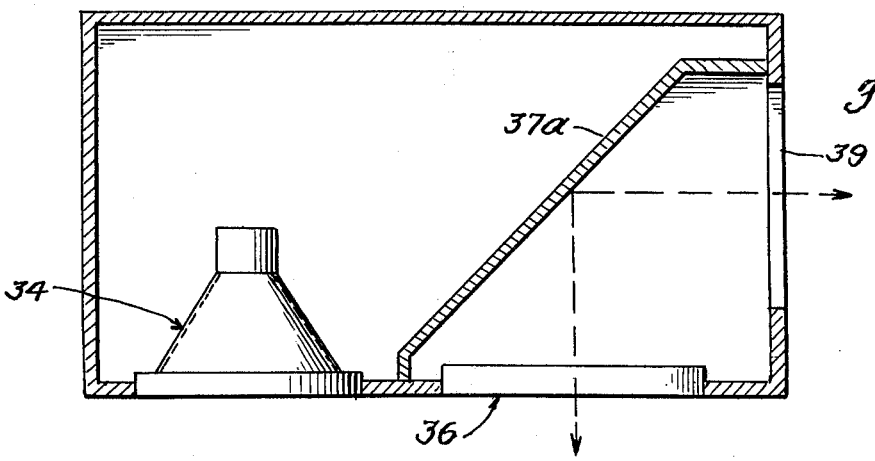

FIG. 5*a* is a simplified schematic diagram illustrating a preferred circuit for use with the typical electrostatic speaker herein illustrated;

FIG. 6 is an enlarged fragmentary sectional view taken as indicated by the section line 6—6 on FIG. 5;

FIG. 7 is a plan view of a spacer layer adapted to be employed in accordance with the invention;

FIG. 8 is an enlarged fragmentary sectional view taken as indicated by the line 8—8 on FIG. 7;

FIG. 9 is a front elevational view of a speaker cabinet embodying a speaker system and an electrostatic speaker in accordance with the present invention;

FIG. 10 is a horizontal sectional view taken as indicated by the section line 10—10 on FIG. 9; and FIG. 11 is a horizontal sectional view through a cabinet and speaker system in a modified form according to the present invention.

In the drawings and in the following description reference is made to a typical electrostatic speaker which is described for purposes of illustration, and it is to be understood that many variations from the speaker illustrated and described may be employed. Some of those variations will be referred to hereinafter following the complete description of the typical embodiment shown.

The embodiment illustrated in the drawings comprises a double ended or push-pull speaker constructed according to the present invention and incorporating a stack or sandwich of parts including a central perforated backing plate or electrode, porous dielectric membrane spacing layers at each side of the backing plate, and the dielectric membranes carrying the conductive coatings, all of these parts being mounted by means of a frame structure at the edges of the parts and having appropriate electrical connections to the backing plate and to the conductive coatings on the membranes in the manner to be described.

In connection with the illustration in the drawings it is to be kept in mind that the thickness of all of the components of the sandwich are exaggerated for purposes of clarity, having in mind that several of the components are so thin as to be difficult to illustrate in actual size. Typical thicknesses which are appropriate in an actual embodiment are given hereinafter.

In the following description of the embodiment illustrated in the drawings, the manner or sequence of assembly of the parts shown will first be set forth, and thereafter the structure, composition, characteristics and operation of the various parts will be explained.

Figure 3:
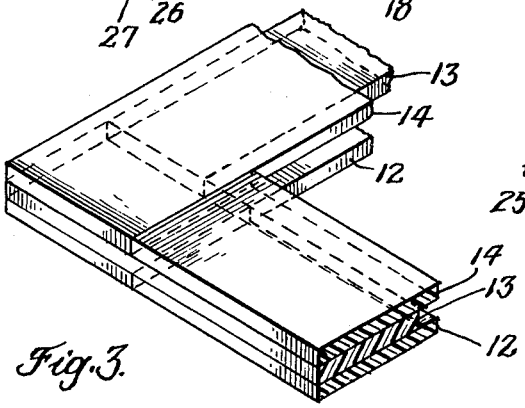
FIG. 3 is a further enlarged fragmentary view in isometric projection illustrating a corner of the frame structure.

The frame for the speaker is made up of simple flat strips 12, 13 and 14. In the embodiment shown the frame is rectangular, and as best seen in FIG. 3, the flat strips are interleaved at the corners of the frame. In a typical assembly operation, the lowermost layer of frame strips 12 are first laid upon a support, with the ends of the strips meeting each other in the manner clearly shown in FIG. 3. The strips 13 are then laid upon the strips 12, with the ends of the strips 13 meeting at the corners in positions providing for overlap of the joints between the strips 12 at the corners. As clearly seen in FIG. 3 the strips 13 are narrower than the strips 12, and the outer edges of the strips 13 are kept in alignment with the outer edges of the strips 12, thereby providing a shoulder around the inner edges of the strips 12.

The perforated plate 15 is then laid upon the shoulder, the plate being cut to a size which will fit just inside of the inner edges of the narrower frame strips 13.

The uppermost layer of frame strips 14 is then laid upon the others, with the ends of strips 14 meeting in the corners in the positions illustrated in FIG. 3, i.e., in position providing for overlap of the joints between the ends of the intermediate strips 13.

In a frame arrangement as just described, with the ends overlapped at the corners as explained, the strips 12 and 14 may all be identical in size and shape, and the intermediate strips 13 a little narrower in size, and a little longer than the strips 12 and 14.

In this frame assembly operation, the several layers of frame strips are adhesively laminated to each other as the frame is built up. The operation thus far described provides the base structure of the speaker, by means of which the speaker may be handled during further assembly operations and may be mounted when the speaker is put in use.

Figure 2:
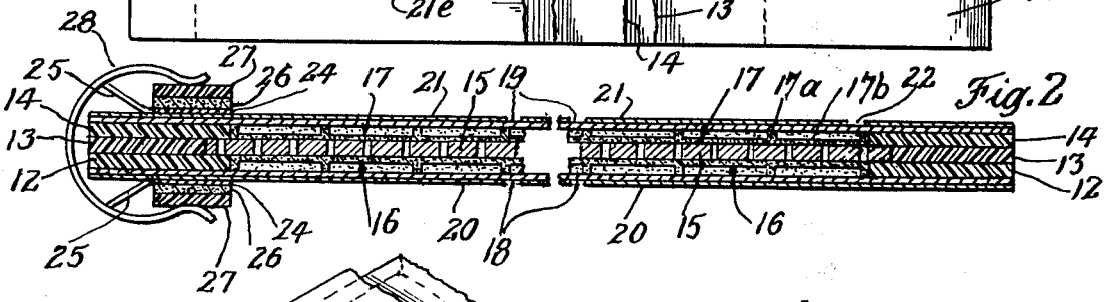
FIG. 2 is an enlarged view taken as indicated by the section line 2—2 on FIG. 1.

After assembly of the frame members with the backing plate, the porous spacer means, here comprising layers 16 and 17 are inserted at opposite faces of the central backing plate 15, as shown in FIG. 2. Thereafter, as seen in FIG. 2, membranes 18 and 19 are applied at opposite faces of the speaker frame, the membranes carrying conductive coatings 20 and 21, the coatings being presented outwardly. The membranes 18 and 19 extend all the way out to the outer edges of the frame members and in a typical operation according to the invention these membranes are smoothed to remove wrinkles and adhesively secured to the frame members, so that the frame members, backing plate, porous spacer layers and membranes now all comprise a single unitary structure. Other means for fastening the membranes to the frames may be adopted, but in accordance with the present invention pretensioning of the membranes is not required.

It will be observed from FIG. 2 that the overall thickness of the perforated plate 15 substantially equals the width of the groove in the frame members formed as a result of use of strips 13 which are narrower than the other frame strips. It will also be seen from FIG. 2 that the overall thickness of the spacer layers 16 and 17 substantially equals the thickness of the frame members 12 and 14. With porous spacer layers 16 and 17 of the thickness just indicated, the bottom and top surfaces of the frame strips 12 and 13 will lie respectively in the planes of the outer surfaces of the spacer layers, so that the membranes will be smooth and flat when applied.

Because of the adhesive lamination of the edges of the membranes to the frame members, and because of the adhesive lamination of the frame members to each other, the interior of the speaker is in effect sealed and, with changes in ambient air temperature or pressure this might tend to interfere with the free or proper action of the membranes. Some vent space is therefore provided through the frame members, thereby ensuring equalization of pressure between the inter-membrane space and the ambient air pressure. This may be done in a variety of ways, for instance by providing one or more small apertures in either or both of the membranes. Such apertures should not be located in a conductive area of a membrane, but can readily be situated within one of the areas 22 or 23 from which the conductive coating has been removed.

It is here mentioned that one of the most important aspects of the invention involves the use of spacer means, such as layers 16 and 17, of special construction and composition, and functioning in a unique manner. However, these important aspects of the invention may best be fully explained after consideration of a number of other features to which reference is now made.

An electrical connection is made to the perforated plate which constitutes one electrode of the speaker system. This connection is provided by means of a self-threading screw passing through apertures in the frame members 12 and 14, but tightly engaging the metal of the perforated plate. Alternatively the electrical contact with the perforated plate may readily be provided by use of a thin aluminum contact strip, for instance of about 0.001 inch thickness. This strip may for example be about ½ inch wide and have one end folded around an edge of the perforated plate and then extended to overlie one of the outer frame members, in which region it may be clamped for electrical contact in any desired manner.

Figure 1:
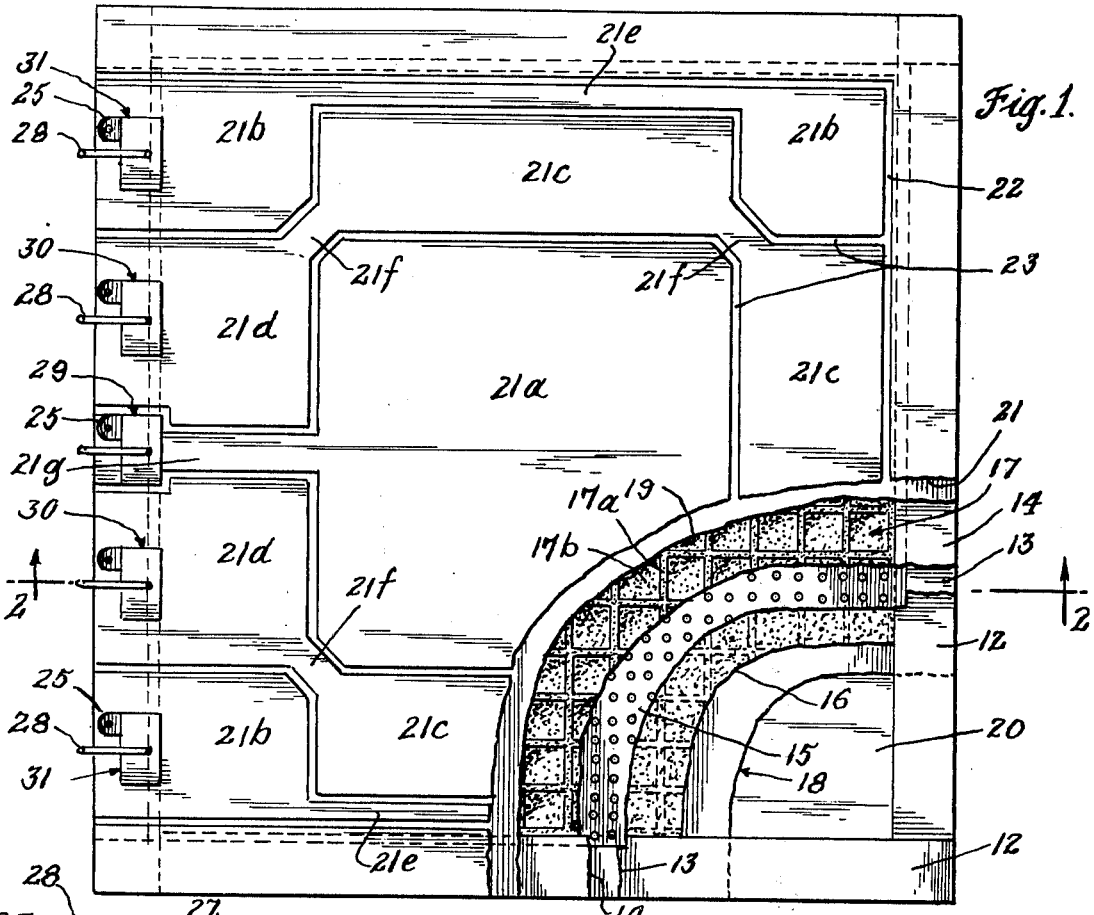
FIG. 1 is a face view of a speaker constructed according to the present invention and in which certain layers of the structure are partially broken out in a corner of the speaker so as to enable illustration of parts lying beneath.

Before considering the manner of providing electrical connections to the conductive coatings 20 and 21 at the outer sides of the membranes 18 and 19, it is now pointed out that the conductive coating on each membrane, for instance the coating on the top membrane which appears in FIGS. 1 and 5, is divided into a plurality of electrically separated parts or areas. This electrical separation may readily be accomplished in a variety of ways, for instance by merely erasing, abrading or etching the coating from the membrane in certain narrow strips such as indicated at 22 and 23. Alternatively, if desired, the membranes may be fabricated with the desired uncoated areas, by applying the coating through a mask, which mask would overlie the strips such as indicated at 22 and 23 in order to prevent deposit of the conductive coating on the membrane in those areas.

In the typical embodiment here illustrated, the strips 22 are arranged in a U-shaped pattern, with the base of the U along the right side of FIG. 1 just inside of the frame line, and with the two legs of the U extended to the left in FIG. 1 just inside of the inner edges of the frame at the top and bottom of the figure, the two legs being extended all the way to the extreme left hand edge of the membrane, so as to electrically isolate the membrane area inside of the U-shaped lines 22 from the areas of the membrane overlying the frame at the top, bottom and right hand side of FIG. 1. The area within the U-shaped lines constitutes the portion of the membrane actively used for sound generation, and by excluding the marginal portions just referred to, some power losses are avoided in the region where the membrane overlaps the frame elements. At the edges of the membrane at the top, bottom, and right hand side of FIG. 1, the conductive coating may be removed or omitted entirely outside of the strip 22.

The pattern of the strips 23 as shown in FIGS. 1 and 5 is such as to provide a relatively large central area 21*a*, four corner areas 21*b*, and edge areas 21*c* and 21*d* which in effect surround area 21*a* and extend between the corner areas 21*b*.

The corner areas 21*b* are interconnected in pairs by strips of the conductive coating indicated at 21*e*, and these two pairs of interconnected corner areas 21*b* have electrical contacts arranged to provide for connection thereof in parallel, and as will be explained these areas are the only areas generating the highest frequency sound waves.

All of the areas 21*c* and 21*d* are interconnected by narrow strips of the conductive coating indicated at 21*f*, and this group of areas, as will further be explained, are of special importance in relation to the generation of the sound waves corresponding to the intermediate frequencies being handled by the speaker.

The central area 21*a* is provided with a narrow neck portion 21*g* of the conductive coating, which serves for electrical connection of this central area, it being contemplated that the central area will be utilized only for the lowest frequencies being handled by the speaker, as will also be explained more fully hereinafter.

Figure 4:
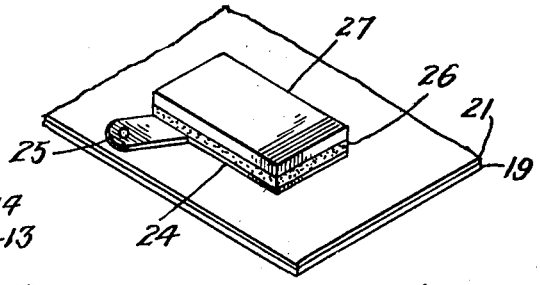
FIG. 4 is an enlarged fragmentary isometric view illustrating a contact device for making electrical connection with the conductive coating on a membrane.

The various membrane areas referred to are extended sufficiently over the frame at the left of FIG. 1 to provide for making electrical contact with the respective conductive coating areas. Each of the contact devices is of the same construction, so that specific description of only one need be given, for instance the upper one shown in FIG. 2, which is also illustrated in FIG. 4. This contact preferably consists of a thin aluminum contact plate 24 having a connection lug 25 near one corner, the lug preferably being bent up to facilitate connection without damage to a membrane or other parts. A sponge or foam resin layer 26 overlies the contact plate and superimposed upon the sponge layer is a block 27 formed of insulating material such as Bakelite. Pressure engagement of the contact plate with the coating on the membrane may be sufficient for contact purposes, but it is preferred to bond the contact plate to the conductive coating, for instance by an adhesive, which may desirably be an electrically conductive adhesive of known type. Advantageously the contact plates are formed of the same or essentially the same metal as the conductive coating itself, in order to avoid tendencies toward corrosion which may develop as a result of use of metals which are separated in the electromotive series.

From FIG. 2 it will be seen that the contact devices for the membrane coatings at the top and bottom sides of the speaker are arranged in positions superimposed with relation to each other and fastening clamps such as the spring clips indicated at 28 serve to retain these parts in assembled relation.

In FIGS. 1 and 5, the several contact devices for the different areas of the speaker are given a general designation. The contact device for the central area 21*a* being designated 29, the two contacts for the areas 21*c* and 21*d* being indicated at 30, 30, and the contacts for the two pairs of corner areas being indicated at 31, 31.

It will be understood that the contact members are used to apply both signal and bias voltages between the perforated plate and the several areas of the two membranes. The bias voltage is connected so as to cause the membranes to be drawn toward the central perforated plate. A suitable circuit for these purposes is shown in FIG. 5*a*.

In FIG. 5*a* the contact devices 29, 30—30 and 31—31 referred to above in relation to FIG. 5 are also shown. In addition, FIG. 5*a* further shows a corresponding series of contacts identified by numerals 29*a*, 30*a*—30*a* and 31*a*—31*a*, which represent the contact devices for the other of the two membranes incorporated in the typical push-pull speaker here under consideration. FIG. 5*a* still further diagrammatically shows the perforated backing plate 15 which lies between the membranes of the speaker.

The letter T indicates an impedance matching transformer that couples the loudspeaker to a low impedance amplifier through an appropriate cross-over network. The center tap of the secondary of this transformer is connected to one side of a high voltage supply HV, the other side of which is connected with the backing plate 15, preferably through a resistor of several megohms. The opposite ends of the secondary of the impedance matching transformer are respectively connected with the contact devices for the two membranes of the push-pull speaker, as is shown, and a frequency dividing resistance network is included in order to divide the frequencies in accordance with the pattern described herebelow.

For the purposes of fully explaining the effect of the frequency dividing networks, it is first pointed out that in a typical speaker such as shown in the drawings, the membrane areas and therefore their capacitance are so proportioned or divided as to give an approximately uniform angular range of radiation throughout the frequency band that the loudspeaker is intended to reproduce. In accomplishing this uniformity of angular radiation, the invention provides that the area and therefore the capacitance of the loudspeaker which radiates the sound gradually decreases with increasing frequency. Preferably, the total area of the speaker radiates the low frequencies, and as the frequency increases area 21*a* is gradually cut off by the resistance network, which forms a low pass filter together with the speaker capacitance, so that areas 21*b*, 21*c* and 21*d* then remain operational. As the frequency is further increased areas 21c and 21d become inoperative by virtue of the network feed and areas 21b alone are then left to radiate the highest frequencies.

The resistance values of the divider networks are so chosen as to give the effects just referred to. In a typical embodiment of the speaker, the series connection of the resistors R1 and R2 serves to cut off the operation of the central area 21a of the speaker, for instance at a frequency of about 2,000 to 3,000 Hz. The resistors R1 serve to cut off the operation of the areas of the speaker indicated at 21c and 21d, for instance at a frequency of 5,000 to 6,000 Hz. Since the areas 21b are fed by direct connection with the transformer, there is no cut off with respect to those areas and they will remain effective up to the maximum frequency of which the system is capable, for instance up to 15,000 to 20,000 Hz.

In a typical speaker such as herein described, the resistor R1 may have a value of the order of 47K ohms, and the resistor R2 may have a value of the order of 68K ohms.

The geometry and dimensional relationships of the several areas of the speaker membrane are also of importance in achieving the foregoing desirable effects in radiation and distribution of the sound generated.

It will be observed that in the pattern of division of the coating on the membrane as illustrated in FIGS. 1 and 5 and described above, there are four small radiation areas 21b, one at each corner of the rectangular speaker. In a typical speaker approximately 10 to 14 inches on each side, and with areas 21b located at the corners and having a maximum dimension of about 2 inches, these corner areas are proportioned for effective angular radiation of the upper frequencies of the audio spectrum, in the range mentioned above. Moreover, the separation of these areas 21b to the corner positions of the membrane is further of advantage in reducing interference between them and in widening the angle of radiation, thereby broadening the distribution of the high frequency radiation by the speaker. The use of four of these small corner areas is also of advantage because this increases the power handling ability at the high frequencies.

Similar effects and results flow from the use of the areas 21c and 21d in relation to the radiation of signals of medium frequencies in the audio spectrum. The distribution of the areas 21c and 21d surrounding the central area 21a and also positioned intermediate the high frequency corner areas 21b aids in rendering the intermediate frequency radiation multi-directional, instead of omni-directional. In a speaker of the dimensions above referred to, and with areas 21c and 21d each having a major dimension greater than any major dimension of the areas 21b, the areas 21c and 21d are proportioned to increase the radiation efficiency in relation to signals of the mid frequency range, for instance the mid range mentioned above.

Similarly the central area 21a, being of large dimension in both directions, is proportioned for effective angular radiation at the low frequency end of the audio spectrum being handled by the speaker. It will be observed that both dimensions of the area 21a are as large as the maximum dimension of the areas 21c.

Effects upon sound generation and frequency distribution of the kind described above can also be achieved in a speaker with a circular membrane having its conductive coating divided into a plurality of concentric annular areas, with a central circular area, and in which the outermost annular area has the smallest width, inner areas progressively increasing the width to the relatively large central area. Indeed, the pattern of membrane areas shown in FIG. 5 in a speaker having a square membrane simulate the effects obtainable in a speaker having a circular membrane with concentric annular areas. While the circular membrane with concentric annular areas represents a theoretical ideal with respect to certain factors such as equalization of radiation angle at different frequencies, a speaker as shown with a square membrane having areas dimensioned and proportioned as herein disclosed approaches or approximates the operating characteristics of the theoretically ideal circular arrangement, while at the same time affording the very substantial constructional and manufacturing advantages incident to the use of a square membrane.

With the square membrane as shown the outermost areas have the smallest dimensions, the innermost area has the largest dimensions, and the intermediate areas have one dimension smaller than the central area and one dimension larger than the outermost areas.

The speaker of the invention may comprise a multiple or push-pull arrangement such as the embodiment illustrated and described or, if desired, may comprise only a single ended speaker embodying a perforated plate and a single coated membrane.

In any event, in speakers according to the present invention a perforated backing plate may be employed of about 0.034 inch in thickness. Aluminum backing plates are highly effective and preferred. The plate should have apertures formed therein on relatively close centers, for instance apertures of about 0.045 inch in diameter. Because of the importance of freedom for air flow between the two opposite sides of the backing plate, it is of importance to have a substantial percent of the backing plate area represented by the apertures. The apertures may comprise from 10 to 90% of the area of the backing plate. It is preferred that from about 25 to about 50% of the area of the backing plate should be represented by apertures.

The membranes are desirably formed of thin films of resin materials such as polyester resin, one form of which is readily available under the Tradename Mylar (E. I. DuPont de Nemours and Co.) These membranes are desirably quite thin, for instance of the order of 0.000125 to 0.001 inch. A membrane having a thickness of 0.00025 inch is effective for many purposes. The metallic or conductive coatings on the membranes may be applied, for instance by the well known vacuum evaporation techniques. Aluminum is effective and preferred for coating purposes and the coating is very thin, of the order of 100 angstrom units, having a resistance of the order of 3 to 5 ohms as measured across a square of the coated membrane.

The spacer layers 16 and 17 desirably comprise a dielectric resinous material having a foam or cellular structure. Such a layer may be of the order of 1/32 inch or 30 mils in thickness, although the layers may be thinner or thicker, for instance down to about 15 to 20 mils or up to about 50 mils. In a typical speaker of about 12 to 14 inches on a side where a range of frequencies of about 1,000 to 20,000 Hz is to be radiated, the spacer layer thickness is preferably less than about 15 to 20 mils, although where only lower frequencies are to be generated the spacer may be thicker, as indicated. In the embodiment illustrated in the drawings, the separator, for instance the upper separator indicated at 17 in FIGS. 1, 7 and 8, is formed from a polyurethane foam sheet of a thickness of about 1/32 inch. The separator is embossed, for instance in the waffle pattern illustrated so as to provide lands 17*a* and valleys 17*b*, the lands being reduced slightly from the original 1/32 inch thickness, and the valleys being about 1/5 to about 1/10 of the thickness of the lands. In a typical speaker embodying polyurethane foam layer of the kind just mentioned, the waffle pattern may comprise lands of about 1/32 inch in width, with valleys spaced on about ¼ inch centers.

In connection with the thicknesses of the various components as referred to above, it is pointed out that corresponding thickness dimensions are assigned to certain strips of the frame structure. Thus, with a perforated plate of 0.034 inch in thickness, the central frame strips 13 will have that same dimension. Similarly, with spacer layers of slightly less than 1/32 inch thickness as described above, the frame strips 12 and 13 will be of corresponding dimension.

Attention is now directed to certain important aspects of the composition and construction of the spacing means. Certain important characteristics and properties to be observed in selecting the material include the following:

The foam material should be dielectric and compressible and resilient. The cell structure of the foam material should be such that the spacing layer is acoustically porous or transparent, or at least acoustically transmissive, and for this purpose it is important that the cell wall structure be "open" or discontinuous, with many cell passages communicating through the layer from one face to the other, thereby providing for substantially uninterrupted acoustic transmission through the spacer layer. Foam having open pore structures with about 100 pores per inch (PPI) are usefully employed.

The resin used and the character of the cell wall structure should also be such as to provide low density and minimum mechanical stiffness, and also have resilience providing for recovery motion following deformation incident to motion or pressure of the membrane against the spacing layer. These characteristics may either be attained by virtue of the cell structure and resin employed and in this case the spacer layer may be of uniform thickness throughout the layer, or alternatively these characteristics may be obtained by the use of a resin and cell structure having a stiffness value somewhat greater than would be preferred with a spacer layer of uniform thickness, in which case it is desirable to employ a spacer layer which is embossed or otherwise formed to have lands and valleys, so that the support for the membrane is effected by the spaced lands only, instead of by contact with the spacer layer throughout its entire area. The embodiment illustrated in the drawings conforms with the second of these two alternatives. Where the membrane is supported only by land areas, the valley areas may even be stamped out or otherwise completely eliminated. The elimination of the valley areas leaves a network of land areas and it is to be understood that such a network may either be continuous with all parts interconnected or may be interrupted, if lesser stiffness is desired.

In any event (use of a porous spacer layer which is either embossed or unembossed or in which some areas are removed), the support for the membrane comprises many points of support widely distributed over the entire surface area of the membrane, in consequence of which the vibratory motion of the membrane is substantially translatory in character. In other words, all unit areas of the membrane have substantially the same amplitude of motion. While it is true that with the embossed type of spacer layer, or with a spacer comprising only a network of land areas, the local areas of the membrane lying between adjacent supporting lands of the spacer layer will partake somewhat of catenary character, nevertheless in all cases the membrane motion approaches the theoretical ideal of pure translatory motion. Since the membrane here employed is not pretensioned, as in certain prior speakers, the degree to which the motion of the local areas will resemble catenoids will depend somewhat upon the stiffness, compressibility and resilience of the resin material and cell structure in the lands of the spacing layer and also upon the dimensions of the land and valley or open areas of the spacer. The compressibility of the spacer is especially important in minimizing catenary motion of the membrane.

In the case of use of a spacer having either a network of lands between open areas or land and valley areas, the spacing between adjacent lands will also influence the extent to which catenary motion or "catenoid depression" of the membrane will occur. It is preferred that the extent of the catenoid depression should not exceed about 20 or 25% of the average spacing of the membrane from the backing plate. For many electrostatic speakers operating within an audio frequency band from about 1,000 Hz to about 20,000 Hz, this limitation with respect to catenoid depression will not be exceeded if the land areas are spaced from each other not more than about 1 or 1½ inches. In a typical embodiment, this spacing may be of the order of from ¼ to ½ inch.

For certain purposes as mentioned hereinafter, the distribution of the areas or points of support of the membrane by the spacer means, may be varied in selected areas of the membrane, but within each of such selected areas the support distribution is preferably uniform.

Whether the spacing means comprises an apertured, embossed or unembossed layer of resin foam, the substantially uniform and wide distribution of support provided for the membrane results in a much closer approximation of translatory motion than is possible with various prior known electrostatic speaker systems in which the support for the membrane is derived from tensioning of the membrane by damping the edges and stretching the membrane in its own plane, and this advantage of the arrangement of the present invention is attained in relation to the prior speakers having tensioned membranes, regardless of whether the perforated or backing plate used is sectionalized or extends in one piece throughout the entire area of the speaker.

The type of support for the membrane according to the invention, providing the approximation to the translatory motion of the membrane, is an important factor in increasing the output of the speaker in relation to signal input. Where the membrane is supported only by tension applied at the edges, the resultant catenary configuration assumed by the membrane in response to a signal voltage results in a very substantial power loss, because the edge portions of the membrane have only a very small amplitude of motion. This source of power loss in an electrostatic speaker is minimized in accordance with the present invention. Moreover, because of the reduction in the catenoid depression, the speaker constructed according to the present invention may carry a higher signal voltage.

The spacer means provided in accordance with the foregoing constitutes a new suspension means for membranes of electroacoustic devices, especially electrostatic speakers, providing numerous important advantages. The provision of compressible membrane support having wide distribution or multiple areas or points of support reduces the catenoid depressions in the membrane to a value which is very small, compared to the spacing between the membrane and the backing plate. In consequence, the membrane motion is for all practical purposes substantially translatory, all parts moving with substantially the same phase and amplitude.

The effects of this improvement on the speaker performance are striking and include extensively increased efficiency, more power handling ability per unit area, wider frequency range, more uniform response over the operational band, accurate maintenance of spacing between the membrane and the backing plate throughout the total area thereof, accurate maintenance of the membrane stiffness per unit area over its total surface, accurate maintenance of the selected or desired low frequency cut off point, and lower manufacturing costs as compared with prior electroacoustic transducers.

If desired, variations in spacer stiffness, in spacer thickness and in certain other characteristics of the spacer or the material of which it is composed, may be introduced in different areas of an electrostatic speaker membrane, for instance in various different areas such as those described above and shown in FIG. 5, in order to alter or control the radiation characteristics at different frequencies. Indeed, the provision of the compressible type of spacer means is of advantage as it lends itself readily to variations of speaker characteristics in order to meet specific desired operating conditions. For example, the ratio of the valley to land areas can be varied in order to vary the stiffness of the membrane. The distance between the lands can be decreased in order to limit the low frequency response of the speaker. Increasing the distance between the lands will result in decreased membrane stiffness, and this condition will favor radiation of low frequencies. The thickness of the spacer may also be varied, and if increased will permit greater membrane motion such as desirable in the reproduction of low frequencies; whereas decrease in the thickness of the spacer will reduce the possible range of membrane motion but will increase the efficiency of radiation regardless of the frequency.

A particularly advantageous readily available resin foam consists of the well known open pore polyurethane foam, which is available in thin sheets of the order of 1/32 inch in thickness and which can be embossed, for instance in the pattern described above. As above pointed out, it is important that the foamed material of which the spacer means is formed should be compressible.

Various other resin foams may be used, for instance, polyethylene foam, but any foam used preferably is of low density, for instance below about 0.06 gms./cm$^3$, and should also have substantial compressibility, for instance a compressibility providing for deflection of at least 25% of its thickness when a sheet of 0.031 inch thickness is subjected to a force of 8 oz./sq. inch.

In accordance with another aspect of the invention, the spread of the radiated signals from a speaker system is improved, especially in the upper range of the audio spectrum in which the radiation frequently tends to become highly directional. The arrangement provided by the invention for this purpose is illustrated in FIGS. 9, 10 and 11, the first two figures illustrating one embodiment of FIG. 11 illustrating another embodiment.

In FIGS. 9 and 10 a speaker cabinet is shown, having a front wall 32 and edge walls 33, 33, the speaker cabinet as a whole being volumetrically rectangular as shown in the drawings. Moreover, as shown in the drawings, the wall structure of the cabinet also includes a back wall extended between the side or edge walls 33, 33. In the speaker system embodied in this cabinet there is a dynamic or cone type of speaker indicated at 34 having an aperture through the front wall in the lower portion of the speaker cabinet below the horizontal partition 35. Above the partition 35 an electrostatic speaker 36 is mounted, for instance of the kind described above, and this speaker is exposed for radiation through the front wall of the cabinet. As appears from FIGS. 9 and 10, the two speakers are mounted in spaced edge-to-edge relation, with the front face of each speaker exposed for sound radiation through the front wall of the cabinet. A pair of baffle walls 37, 37 are arranged within the upper portion of the cabinet in vertical planes at right angles to each other meeting at an apex lying just behind the electrostatic speaker 36, as clearly appears in FIG. 10. These baffle walls thus extend at oblique angles providing for reflection of sound from the back of the electrostatic speaker toward the edges of the cabinet. The edge walls 33, 33 of the upper portion of the cabinet are also provided with apertures or openings 38, 38 adjacent the electrostatic speaker in position to provide for radiation of a sound wave from the back face of the electrostatic speaker reflected by the angled baffle walls 37.

With this system, still further widening of the radiation angle is provided in a typical listening area and a power economy is also effected because of the utilization of a signal radiated from the back face of the electrostatic speaker as well as from the front face.

In the modified speaker cabinet of FIG. 11, the dynamic speaker 34 is positioned side by side with the electrostatic speaker 36 and a single inclined baffle wall **37*a* is positioned within the cabinet behind the speaker 36 so as to reflect the signal generated at the back of the electrostatic speaker laterally to only one side of the cabinet through the opening 39 in the end wall. It will be understood that the wall 35 in the arrangement of FIGS. 9 and 10, and the baffle wall 37*a* in the arrangement of FIG. 11**, are arranged in a manner to separate the volume within the cabinet behind the electrostatic speaker from other portions of the speaker cabinet.

The speaker system and cabinet arrangement of FIGS. 9 and 10 is well adapted to use in a console type of speaker cabinet, whereas the arrangement of FIG. 11 is well adapted for use in the so-called bookshelf type of speaker cabinet.

I claim:

1. A speaker system comprising a cabinet having enclosing wall structure including front and side walls, lower frequency range dynamic and higher frequency range electrostatic speakers mounted in the cabinet in spaced edge-to-edge relation, with the front face of each exposed for sound radiation through a separate opening in the front wall thereof, a sound radiating opening through at least one side wall of the cabinet adjacent to the electrostatic speaker, the wall structure of the cabinet further including a back wall extended from one side wall to the opposite side wall behind the dynamic speaker, the wall structure of the cabinet including the front, side and back walls of the cabinet defining a volumetrically rectangular enclosure within which the rear face of each speaker is exposed, and baffle structure within the cabinet dividing the rectangular volume within the speaker enclosure into separate portions in which the rear faces of the dynamic and electrostatic speakers are respectively exposed, the baffle structure including a baffle wall dividing said separate portions of said volume from each other, said baffle wall being positioned behind the electrostatic speaker at an oblique angle providing for reflection of sound from the back of the electrostatic speaker through the opening in the side wall of the cabinet.

2. A speaker system comprising a cabinet having enclosing wall structure including front and side walls, lower frequency range dynamic and higher frequency range electrostatic speakers mounted in the cabinet in spaced edge-to-edge relation, with the front face of each exposed for sound radiation through a separate opening in the front wall thereof, a sound radiating opening through at least one side wall of the cabinet adjacent to the electrostatic speaker, the wall structure of the cabinet further including a back wall extended from one side wall to the opposite side wall behind the dynamic speaker, the front, side and back walls of the cabinet defining a volumetrically rectangular speaker enclosure, and baffle structure within the cabinet dividing the rectangular volume within the speaker enclosure into separate chambers in which the dynamic and electrostatic speakers are respectively located and including a baffle wall positioned behind the electrostatic speaker at an oblique angle providing for reflection of sound from the back of the electrostatic speaker through the opening in the side wall of the cabinet, the wall structure defining the chamber in which the dynamic speaker is enclosed including wall elements which inhibit sound radiation from the dynamic speaker.

3. A speaker system as defined in claim 2 in which the speakers are horizontally offset from each other and in which a sound radiating opening is provided in only one of the side walls of the cabinet adjacent to the electrostatic speaker.

* * * * *